United States Patent [19]

Westelaken

[11] 4,152,841

[45] May 8, 1979

[54] FLOW CONTROL METERS FOR GRAVITY FLOW PARTICLE DRYERS

[76] Inventor: Christianus M. T. Westelaken, R.R. #1, St. Marys, Ontario, Canada

[21] Appl. No.: 886,682

[22] Filed: Mar. 15, 1978

Related U.S. Application Data

[63] Continuation-in-part of Ser. No. 729,730, Oct. 5, 1976, abandoned.

[51] Int. Cl.[2] ..... F26B 17/12

[52] U.S. Cl. ..... 34/167; 34/168; 34/171; 222/274

[58] Field of Search ..... 34/65, 66, 164–167, 34/171, 173, 178, 147, 185, 186, 56, 236, DIG. 2; 214/17 D; 432/77–79; 222/271–274, 268; 259/154; 110/259

[56] References Cited

U.S. PATENT DOCUMENTS

| | | | |
|---|---|---|---|
| 1,003,402 | 9/1911 | Hanna, Jr. | 110/259 |
| 2,642,206 | 6/1953 | Reed | 34/165 |
| 2,765,957 | 10/1956 | Andres | 222/274 |
| 2,858,123 | 10/1958 | Niems | 34/167 |
| 2,946,132 | 7/1960 | Armstrong | 34/167 |
| 3,053,522 | 9/1962 | Applegate | 34/174 |
| 3,182,969 | 5/1965 | Rupp | 259/154 |
| 3,489,321 | 1/1970 | Kirschmann | 222/268 |
| 3,721,017 | 3/1973 | Niems | 34/167 |

*Primary Examiner*—Henry C. Yuen

[57] ABSTRACT

An improved metering discharge device for particulate material, particularly grain, is described. The device comprises a plurality of tubes extending downwardly from a lower region of a vessel, particularly in uniformly spaced relationship across the bottom of a gravity flow grain drying chamber. Each tube has an upper end flow connected to the drying chamber and a closed lower end and also has a pair of opposed openings in the side walls. A rotatable auger extends laterally through the tube via the side wall openings. The tubes preferably arranged in straight rows with a single auger extending through each row. This combination of tubes and augers provides a simpler design as well as a more precise flow metering than prior metering rolls. Also included are a plurality of laterally spaced, inverted channel members with open bottoms extending across the drying tower immediately above the discharge floor structure, these channel members being adapted to distribute cooling air into the grain in the tower.

4 Claims, 8 Drawing Figures

FLOW CONTROL METERS FOR GRAVITY FLOW PARTICLE DRYERS

BACKGROUND OF THE INVENTION

1. Field of the Invention

This invention relates to an improved metering discharge device for particulate material, such as grain, and is a continuation-in-part of application Ser. No. 729,730 filed Oct. 5, 1976 (now abandoned).

2. Summary of the Prior Art

Damp grain, such as corn, rice, wheat, beans, etc. is frequently dried by means of heated air in a drying column or tower. Such a drying column or tower normally includes a grain reservoir having a grain inlet at the top and a grain outlet at the bottom and being adapted to have the grain pass through in a confined mass. It also includes spaced orifices communicating with the interior of the reservoir and each adapted to either serve as an air inlet or outlet with means for circulating air between the orifices and through the mass of grain.

A popular type of dryer is the concurrent-counter-current flow grain dryer in which hot drying air travels downwardly in the same direction as the flowing grain and a counter-current flow of cooling air travels in an opposite direction to the direction of grain travel. With this system, air exhaust means are provided intermediate the hot air inlet and cooling air inlet.

With drying systems of the above type, the movement of the mass of grain down the drying column must be very carefully controlled and in the past this has been done by means of metering rolls in a bottom portion of the dryer, such as those illustrated in Rathbun, U.S. Pat. No. 3,710,449 issued Jan. 16, 1973. The rolls shown in this patent are typical of those used in the grain drying industry and are in the form of a shaft with a series of radially extending paddles or blades which pass the grain through gaps in the floor of the dryer. These metering rolls must be particularly designed for the purpose and are expensive to construct. Moreover, because of the long support span of each roll, it is difficult to prevent some sagging which results in unequal rates of grain flow in different metering rolls and in different portions of each metering roll. This is, of course, highly undesirable in terms of obtaining a smooth, uniform travel of the mass of grain down through the dryer, whereby uniform drying is achieved.

It is, therefore, the purpose of the present invention to provide an improved design of metering means for grain dryers which will overcome the construction difficulties as well as the operating difficulties encountered with the previous metering rolls.

In accordance with the present invention there is provided a device for the metered discharge of grain at a controlled rate from a drying tower containing this grain. The discharge device comprises a discharge floor structure for a grain drying tower, said floor structure comprising a horizontal floor member having a plurality of substantially uniformly spaced apertures of substantially uniform transverse dimensions, said apertures being arranged in a plurality of straight rows having a plurality of apertures in each row, a tube member extending downwardly beneath each said aperture, each said tube member having a bottom end closure and a pair of opposed circular openings in the side walls thereof with the side wall openings in all tubes in each row being in axial alignment, a cylindrical sleeve mounted in each said circular opening and a rotatable auger extending axially through each row of sleeves. Also extending across the drying tower immediately above said discharge floor structure for operative cooperation therewith are a plurality of laterally spaced, inverted channel members with open bottoms for distributing cooling air into the grain in the tower. The channel members in this position prevent any problems of substantial quantites of dust and chaff from the grain tending to collect in the tube members and augers.

Since there can be quite close tolerances between the flight of the auger and the periphery of the openings, it will be seen that flow of grain out of the vessel can be stopped and started with great accuracy and the rate of flow can also be controlled with great accuracy. Moreover, since the auger is supported by each tube, it will be seen that if all augers in a dryer are rotated at a uniform speed, the particulate material will emerge at an absolutely uniform rate from all tubes. Furthermore, with the augers simply resting within the tube side wall openings, no cumbersome support hangers, etc. are required.

For a large commercial dryer, the tubes are normally arranged in parallel rows with a single auger extending laterally through all tubes in each row. In this way the tubes can be substantially uniformly spaced across the entire bottom of the dryer.

The location and design of the cooling air delivery channels are also important features of this invention. Thus, the dryer can be used for the direct drying of grain as harvested without any precleaning, with the result that considerable amounts of chaff, dust, etc. are contained in the grain. It has been found in certain designs of dryers that considerable amounts of this dust and chaff tends to accumulate within the discharge floor tubes and thereby interfer with the uniform discharge of grain through the augers. Of course, in order to have a uniform drying of the grain in the tower, the columnar mass of grain must move down through the tower in a uniform manner and this means that all of the augers of the discharge floor must discharge the grain at a uniform rate.

Thus, according to one of the features of this invention, by using cooling air delivery channels in the form of inverted members with open bottoms extending across the drying tower immediately above the discharge floor structure, the problem of dust and chaff tending to collect in the tubes and augers was avoided. It appears that with this particular configuration, the air emerges from the bottoms of the channel members in a generally downward direction and then loops upwardly towards the discharge floor. However, because of the initial downward movement of the cooling air from beneath the channels, some of this downwardly moving air is directed into the tubes and this air movement has the effect of carrying downwardly any light chaff, dust, etc. which might have a tendency to collect in those locations. It has been found that this slight entrainment of air is sufficient to eliminate the problem of chaff and dust accumulation.

Certain preferred embodiments of the invention are illustrated by the following drawings in which.

Figure 2:
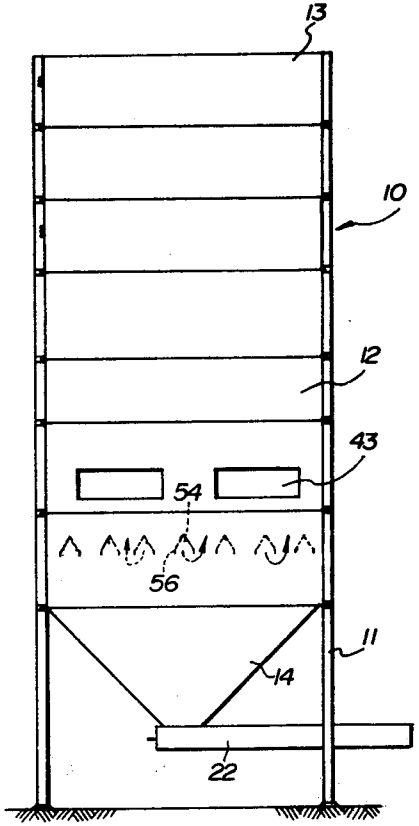
FIG. 2 is an end elevation of the grain drying tower shown in FIG. 1.
Figure 1:
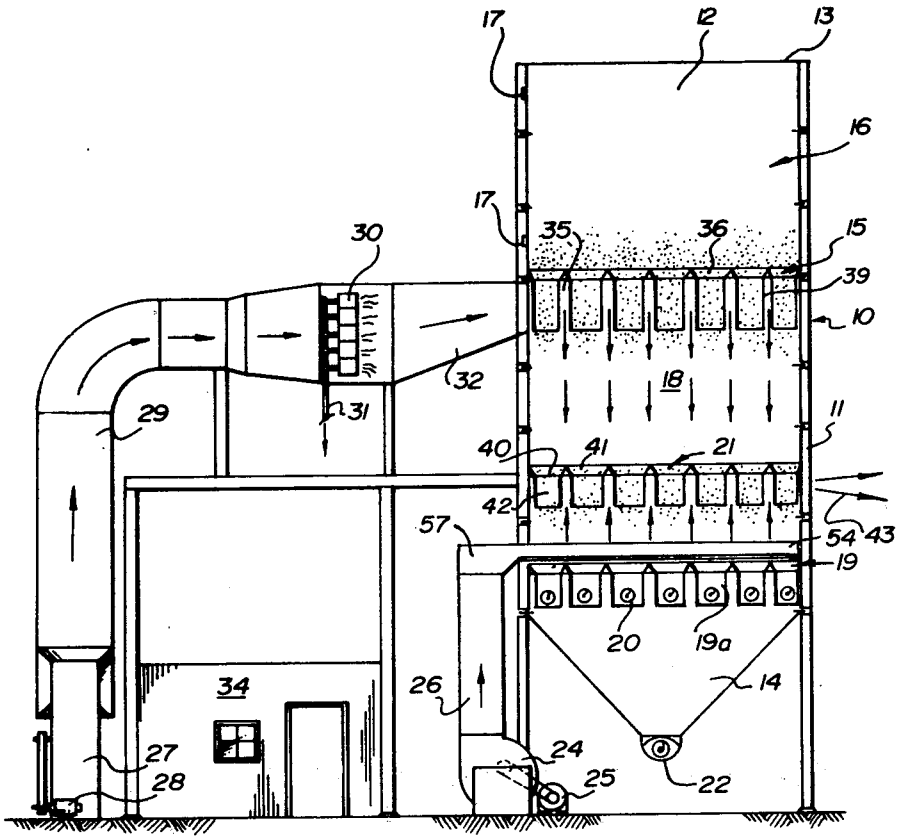
FIG. 1 is an elevation view of a grain dryer incorporating the metered discharge device of this invention.
Figure 3:
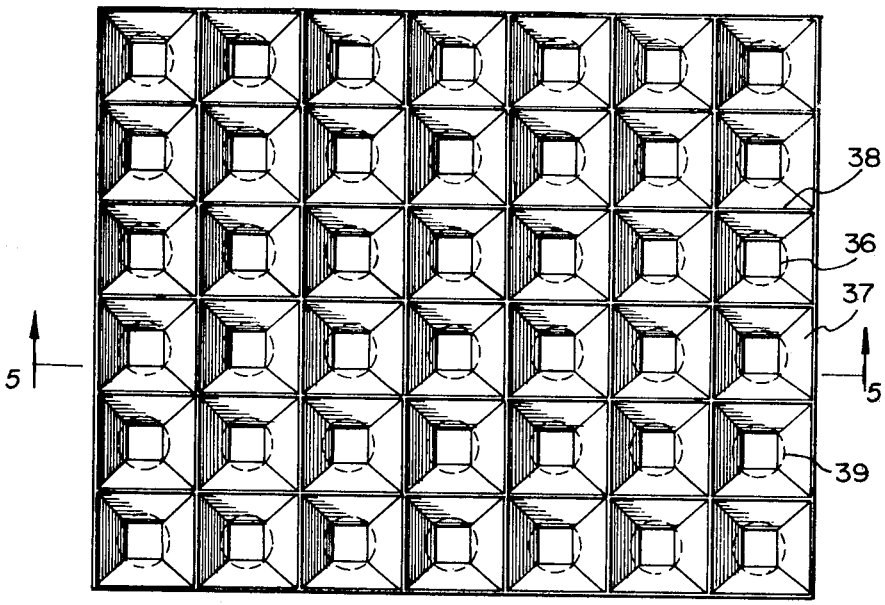
FIG. 3 is a top plan view of a drying floor assembly.
Figure 4:
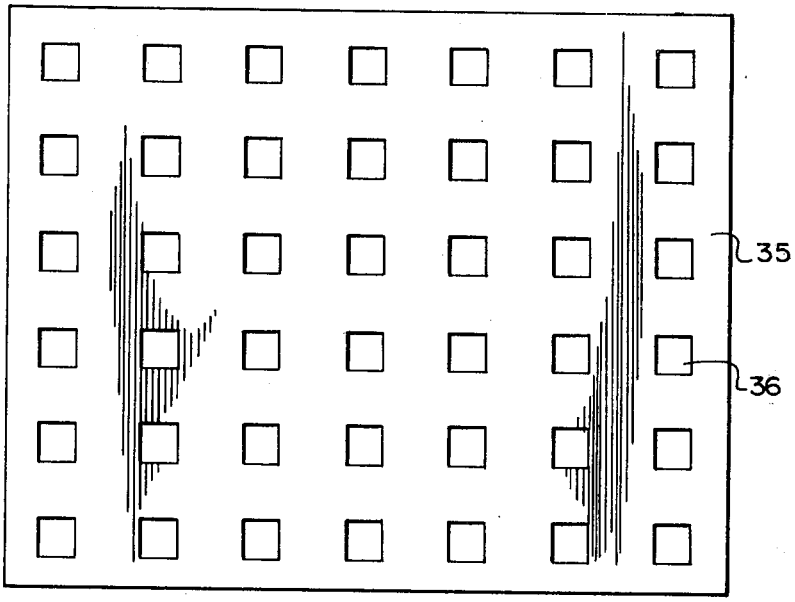
FIG. 4 is a plan view of a plate member forming part of the floor assembly.
Figure 5:
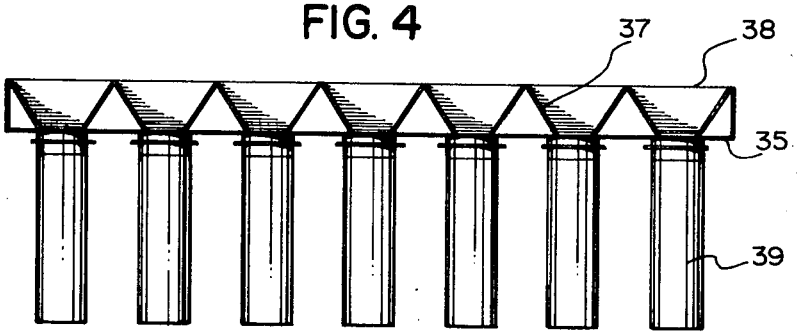
FIG. 5 is a side elevation in partial section of the floor assembly of FIG. 3.

Referring to FIGS. 1 to 5, a commercial dryer includes a tower 10 constructed in a series of sections including frame members 11, sheet metal panels 12, a top 13 and a bottom hopper 14.

Proceeding from the top of the tower there is provided a wet grain holding bin 16 with low and high level indicators 17 for maintaining a proper level within the bin. A floor assembly 15 forms the bottom of bin 16 and beneath this floor assembly is the drying chamber 18. The bottom of this chamber is formed by a floor assembly 19 with down tubes 19*a* and flow metering augers 20, according to the present invention. At a location intermediate the floor assembly 15 and the floor assembly 19 is a further floor assembly 21 through which exhaust air passes to the outside.

The bottom portion of the tower 10 is in the form of a dry grain receiving hopper 14 at the bottom of which is a grain screw 22 for removing grain from the hopper. To maintain an air lock, the grain screw is choke loaded and is controlled so as to maintain a depth of grain in the hopper 14 of about 90 to 120 cm.

Cooling air is supplied by way of duct 26 to the bottom of the drying chamber from blower unit 24 which is driven by an electric motor 25.

Hot air is supplied to the upper end of the drying chamber by means of blower 27 and electric motor 28. This blower forces ambient air up the duct 29 and through burner unit 30 which is connected to a gas supply 31. Here the air is heated and the hot air is passed into the drying chamber by way of duct 31. The hot air supply system can conveniently be supported on a frame structure which can also form a portion of the structure of a control room 34.

The contact of the wet grain with the hot drying air is carried out by means of the floor assembly 15, details of which are described in U.S. Pat. No. 4,086,708. From FIGS. 3-5, it will be seen that the floor assembly includes a bottom plate member 35 with a series of equally spaced square openings 36. Extending upwardly and outwardly from the four edges of these holes are inclined panel members 37 with the upper edges of the panel members of adjacent pairs of holes forming a ridge 38. In this fashion the entire floor area is formed of inclined faces having an angle greater than the angle of repose of the wet grain. The floor is thereby entirely self-cleaning so that there is no necessity to remove any grain from the floor manually at the end of a run through the unit. Also, this combination of welded, inclined panels act as a reinforcing assembly producing a rigid, self-supporting and light-weight floor assembly. Connected to the bottom of plate 35 beneath each hole is a square or cylindrical delivery tube 39.

With this system the hot air entering through duct 32 is distributed in the spaces between the tubes 39 and comes into direct contact with thin layers of cool damp grain being cyclically distributed across the drying chamber from the tubes 39.

A similar floor assembly is used for the air exhaust including a horizontal floor plate 40 with a series of equally spaced square holes 41. Connected to the bottom of plate 40 beneath each hole 41 is a cylindrical delivery tube 42 made of perforated metal. The exhaust air passes through the perforations in these tubes and exhausts to the outside through outlets 43 in the wall of the column.

Figure 6:
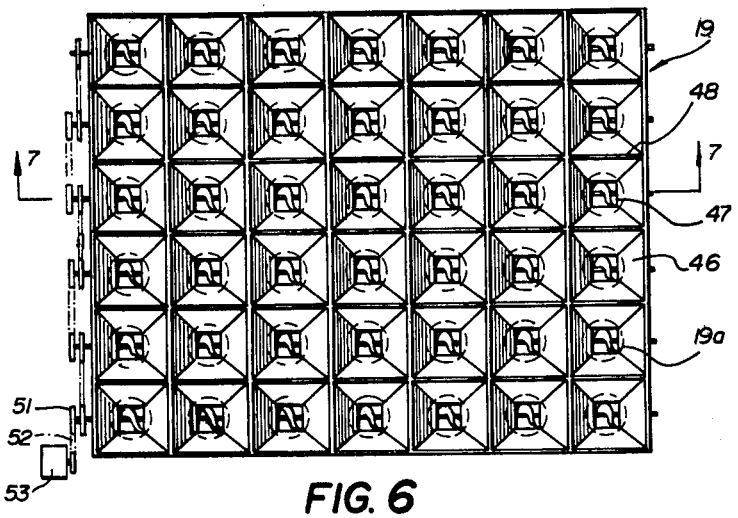
FIG. 6 is a top plan view of a floor assembly incorporating the discharge mechanism of this invention.
Figure 7:
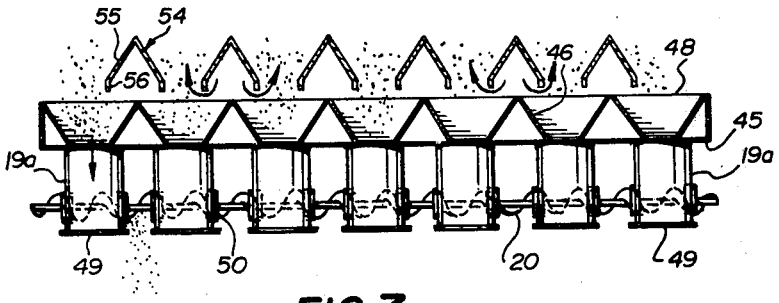
FIG. 7 is a side elevation in partial section of the floor in FIG. 6.
Figure 8:
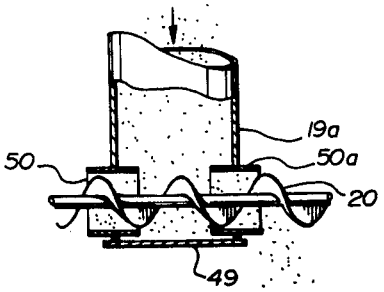
FIG. 8 is a sectional side elevation showing details of a single tube.

The metering floor is described in greater detail in FIGS. 6, 7 and 8. The basic structure of the floor is similar to that of floor assembly 15 and, as will be seen from FIGS. 6 and 7, it includes a bottom plate 45 with a series of equally spaced square openings 47. Extending upwardly and outwardly from the four edges of these holes are inclined panel members 46, the upper edges thereof forming ridges 48 to produce a self-cleaning floor. Connected to the bottom of plate 45 beneath each hole 47 is a cylindrical delivery tube 19*a*. Across the bottom of each tube 19*a* is a closure plate 49. Each tube 19*a* includes a pair of laterally opposed holes 50 and fixed within each hole 50 is a short cylindrical sleeve 50*a*. The auger 20 extends through these sleeves 50 in the manner shown in FIGS. 7 and 8. These tubes and augers are arranged in parallel rows as will be evident from FIG. 1 and are connected to operate at uniform speeds by means of a chain drive 52 and sprockets 51 driven by a variable speed drive 53.

The cooling air distribution system is an important feature of this invention and includes a series of inverted channels 54 with open bottoms extending across the drying chambers a short distance above the discharge floor assembly 19. The cooling air is carried across the drying chamber in the pockets beneath the channels 54 and the air moves from these pockets into the grain bed as shown in FIG. 6.

According to a preferred embodiment the inverted channels are V-shaped and can include short vertical leg portions 56 extending from the lower ends of the inverted V-shaped parts for additional strength. The cooling air inlut duct 26 connects to a manifold 57 of known type which delivers the cooling air into the channels 54 through holes in the wall of the tower adjaent the ends of the channels.

The arrangement and positioning of the channels 54 was found to be an important consideration in the proper operation of the discharge auger. Thus, the dryer is used for the direct drying of grain as harvested without any precleaning, with the result that considerable amounts of chaff, dust, etc. are contained in the grain. Initially, cooling air was introduced through perforations in the inclined panel members 46 or through perforations in the tubes 19*a*. However, in operation, problems were being encountered in that chaff and dust were accumulating within the tubes 19*a* and interfering with the uniform discharge of grain through the augers. It is, of course, most important for the grain discharge rate to be substantially uniform across all of the tubes 19*a* so that the columnar mass of grain will move down through the dring tower in a uniform manner.

The solution to the problem of accumulating chaff and dust was found to be the arrangement of cooling air channels 54 as shown in FIG. 7. By arranging the channel members in the inverted position with the open bottoms, the air emerges in a generally downward direction and then loops upwardly towards the discharge floor 21. However, because of the initial downward movement of the cooling air from beneath the channels 54, some of this downwardly moving air is directed into the tubes 19*a*, having the effect of carrying downwardly any chaff, dust, etc. so that it is uniformly discharged with the grain. It is believed that when the air was introduced through either the panels 46 or the tubes 19*a*, the upward movement of cooling air within the tubes 19*a* had the effect of holding the light chaff and dust so that it accumulated in quantities within the tubes 19*a*. The arrangement of channels 54 was found to be a complete solution to this problem.

In terms of maximum efficiency, it is particularly desirable to arrange the inverted channels 54 directly over ridges 48 so as to provide a direct flow path for the grain into the tubes 19*a*.

I claim:

1. In a grain drying tower of the concurrent-countercurrent flow type in which hot drying air travels downwardly in the same direction as the flowing grain and cooling air travels in an opposite direction to the direction of grain travel, with an air exhaust exit at a location intermediate an upper hot air inlet and a lower cooling air inlet, the combination which comprises (a) a discharge floor structure at the bottom of the tower comprising a horizontal floor member having a plurality of substantially uniformly spaced apertures of substantially uniform transverse dimension, said apertures being arranged in a plurality of straight rows, a tube member extending downwardly beneath each said aperture, each said tube member having a bottom end closure and a pair of opposed circular openings in all tubes in each row being in axial alignment, a cylindrical sleeve mounted in each said circular opening and a rotatable auger extending axially through each row of sleeves and (b) a plurality of substantially uniformly laterally spaced, inverted channel members with open bottoms extending across said drying tower immediately above said discharge floor structure, said channel members being adapted to distribute cooling air into the grain in the tower with a said channel member being positioned above and laterally between each pair of adjacent rows of said discharge floor apertures and said channel members being vertically positioned such as to provide a slight downward entrainment of said cooling air through said discharge floor apertures sufficient to substantially prevent accumulation of dust or chaff in said tubes and augers.

2. A device according to claim 1 wherein the floor apertures are substantially square.

3. A device according to claim 2 wherein inclined panel members extend upwardly and outwardly from the edges of each square aperture, forming funnel-shaped entries, with the upper edges of the panels of adjacent apertures being joined to form ridges, whereby the floor is self-cleaning.

4. A device according to claim 1 wherein the cooling air channels are inverted V-shaped.

* * * * *